US005129518A

United States Patent [19]

Tanaka et al.

[11] Patent Number: 5,129,518

[45] Date of Patent: Jul. 14, 1992

[54] PLASTIC FILM PACKAGE WITH PERFORATED EDGE PORTIONS

[75] Inventors: Katsuhiro Tanaka, Kanonji; Shoichi Katoh; Kenji Ohishi, both of Kagawa, all of Japan

[73] Assignee: Okura Industrial Co., Ltd., Japan

[21] Appl. No.: 630,166

[22] Filed: Dec. 19, 1990

[30] Foreign Application Priority Data

Dec. 22, 1989 [JP] Japan ..... 1-333680
May 8, 1990 [JP] Japan ..... 2-119319

[51] Int. Cl.[5] ..... B65D 65/28

[52] U.S. Cl. ..... 206/497; 206/484; 229/87.05

[58] Field of Search ..... 206/497, 610, 622, 629, 206/631, 632, 484; 229/87.05

[56] References Cited

U.S. PATENT DOCUMENTS 3,497,131 2/1970 Tracy ..... 206/497 X
4,343,402 8/1982 Holmstrom ..... 206/622
4,658,963 4/1987 Jud ..... 206/632
4,917,247 4/1990 Jud ..... 206/610

FOREIGN PATENT DOCUMENTS 61-81932 4/1986 Japan .
61-127459 6/1986 Japan .
0205572 8/1990 Japan ..... 206/497

*Primary Examiner*—Bryon P. Gehman
*Attorney, Agent, or Firm*—Lorusso & Loud

[57] ABSTRACT

A package is disclosed which includes an enclosed article, and a thermally shrinkable, synthetic resin film enclosing the article and having opposite, first and second edge portions, the first edge portion being superimposed on and sealed to the second edge portion to form a sealed, overlap portion, the film having perforations arranged in a row in at least one of the first and second edge portions and a coating of a seal-preventive agent provided in part of the overlap portion for weakening the seal in the overlap portion.

6 Claims, 3 Drawing Sheets

PLASTIC FILM PACKAGE WITH PERFORATED EDGE PORTIONS

BACKGROUND OF THE INVENTION

1. Field of the Invention

The present invention relates to a package of an article enclosed with a thermally shrinkable, synthetic resin film, capable of being opened with ease.

2. Description of Related Art

Conventional techniques for readily opening thermally shrinkable packing articles formed from thermally shrinkable, synthetic resin films include: a process for opening the packaged article by breaking it at its perforation portion disposed to be opened at an appropriate position (as disclosed in Japanese Patent Laid-open Publication (KOKAI) No. 127,459/1986); a process for opening the packing article from an ink-printed portion so disposed as not to be thermally fusion-bonded to the sealing surfaces of the packing article, the sealing surfaces being so arranged as for its films to be folded at their edge portions in an L-shaped form and as to be thermally fusion-bonded and sealed at their exterior edge portions to each other when packing materials are packed in the packing article and thermally sealed by a heating plate in packing materials (as disclosed in Japanese Patent Publication (KOKOKU) No. 5,160/1972); and a process for pulling a label inserted into an overlapping portion at which the envelope is bonded and sealed by attaching the label at the edge portion of a thermally shrinkable, synthetic resin film and forming the film into a cylindrical body by superimposing and overlapping both edge portions of the film (as disclosed in Japanese Patent Laid-open Publication (KOKAI) No. 81,932/1986).

The process for forming the perforations, however, has the drawbacks that the holes for the perforation portions may be expanded upon thermal shrinkage and the air within the packing article may be discharged at once, thereby impairing the finish of thermally shrunk packing, or the packing article may be broken by accident or unintentionally at the holes of the perforation during handling. The process of thermally sealing both edge portions of the packing article, on the other hand, suffers from the disadvantages that the bonding edge portions of the packing may be transformed due to heat shrinkage caused by the heat sealing or that the bonding portions so project from the packing article, that its appearance looks poor. The packing articles prepared by this process suffer the drawback that their sealing end portions projecting from the package articles interfere with each other and they stack on each other in an unstable manner. Further, the thermally shrunk package prepared by attaching the label to an edge portion where one film is superimposed on the other film so as to overlap has the drawback that the package article cannot be opened with ease even if the label would be pulled because there is no break on the package.

SUMMARY OF THE INVENTION

Therefore, the present invention has the object to provide a package which can overcome the drawbacks which conventional packing articles suffer from and which can be opened with ease while maintaining better appearance.

In order to achieve the above object, one aspect of the present invention consists of a package comprising an enclosed article, and a thermally shrinkable, synthetic resin film enclosing the article and having opposite, first and second edge portions, said first edge portion being superimposed on and sealed to said second edge portion to form a sealed, overlap portion, said film having perforations arranged in a row in at least one of said first and second edge portions and a coating of a seal-preventive agent provided in part of said overlap portion for weakening the seal in said overlap portion.

In another aspect, the present invention consists of a package as described hereinabove, wherein said perforations are formed only in the second edge portion.

In a further aspect, the present invention consists of a package as described hereinabove, wherein said coating is formed between the row of the perforations of said second edge portion and the end of said first edge portion.

In a still further aspect, the present invention consists of a package as described hereinabove, wherein said perforations are formed at least in said first edge portion and said coating is formed between the row of the perforations of said first edge portion and the end of said second edge portion.

In a still further aspect, the present invention consists of a package as described hereinabove, wherein said perforations are formed at least in said second edge portion and said coating is formed between the row of the perforation of said second edge portion and the end of said edge portion.

For the package according to the present invention, perforations are provided on at least one of the film edge portions and an agent for preventing the so superimposed as film edge portions so superimposed as which overlap with each other from being sealed forms a coated portion between the film edge portions. The overlap portion of the film edge portions is then subjected to electrostatic treatment, thereby bonding the overlap portion and forming the thermally shrinkable packing material, for example, in a cylindrical form. After an article to be packed has been inserted into the packing, the front and rear ends of the packing are fusion-sealed and then the article is thermally shrunk.

The position in which the perforations are formed should be within the portion where the film end portions are superimposed on and overlap partially with each other so as to allow the coated portion to overlap with the overlapped part of the film edge portions. Preferably, the perforations are to be formed only on a film edge portion disposed underneath the other film edge portion, (the film edge portion disposed underneath is called the second edge portion in this embodiment).

The coating should be located so as to overlap at least partially with the portion in which the both film edge portions are superimposed, overlapped and bonded to each other. Preferably, the coating is disposed to lie between the edge of one edge portion the perforation when the perforation is formed on the other edge portion.

It is to be noted that in the most preferred embodiment the perforation is formed only on the second edge portion and the coated portion is disposed between the edge of the first edge portion and the perforation.

As the seal-preventive agent, namely, as the agent for preventing the film edge portions from being sealed together, there may be employed any which can prevent the electrostatic sealing from producing high adhesion or any which prevents sealing strength due to blocking by heating during thermally shrinking packing treatment. Particulary, preferred is one having the combined characteristics as described hereinabove.

For example, inks and resins to be employed for the aforesaid purposes may include, for example, inks employing acryl-type resins as a medium, silicone resins and polyvinyl alcohols.

Also, the antistatic agents to be used therefor are not restricted and they may include, for example, cation-type and anion-type surfactants. A nonionic-type surfactant may also be employed. Further, an antistatic agent of an ester type may be used. Particularly desirable is an antistatic agent containing a special carboxylate type copolymer such as a modified substance obtainable from an unsaturated bibasic acid anhydride of a polyolefin and so on as a starting material.

Further, the anti-blocking agent to be employed is not restricted and may include which has been conventionally employed for general synthetic resins. It may be, for example, an anti-blocking agent of a silica type.

BRIEF DESCRIPTION OF THE DRAWINGS

Other objects, features and advantages of the present invention will become apparent in the course of the description of the preferred embodiment which follows, in conjunction with the accompanying drawings, in which.

DESCRIPTION OF THE PREFERRED EMBODIMENTS

Figure 1:
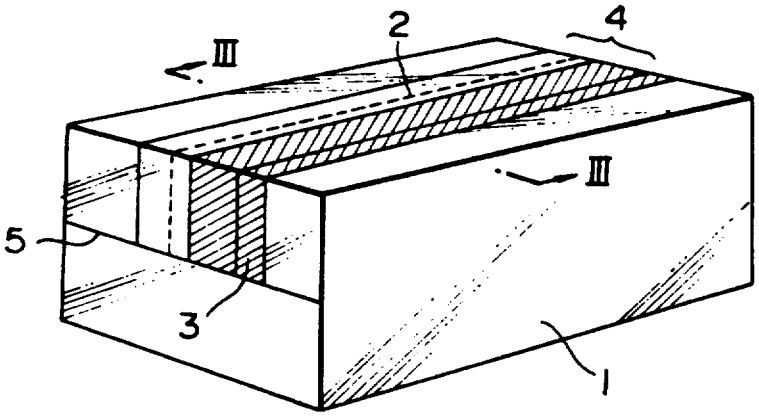
FIGS. 1 and 2 are perspective views showing embodiments of the package according to the present invention.
Figure 3:
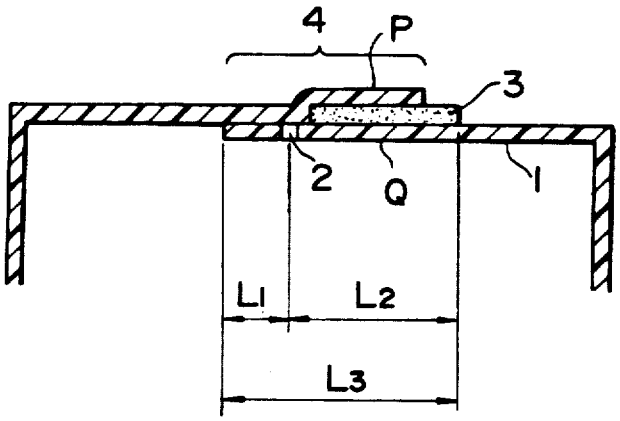
FIG. 3 is a schematic sectional view taken along line III—III of FIG. 1.

Referring first to FIGS. 1 and 3, designated as 1 is a thermally shrinkable, synthetic resin film enclosing an article (not shown). The film 1 has a first edge portion P and a second edge portion Q. As specifically shown in FIG. 3, the second edge portion Q of the thermally shrinkable, synthetic resin film 1 is provided with perforations 2, namely, a series of small holes, and a coated portion 3 which is a continuous layer of a coating of an agent for preventing the edge portions of the film 1 from being sealed together. The first edge portion P is superimposed on the second edge portion Q to form an overlap portion 4 which covers the perforations 2 and which overlaps partially with the coated portion 3. It is important that the row of perforations and at least part of the coated portion 3 should be located in the overlap portion 4. The perforations 2 may be formed either in one of the first and second edge portions P and Q or, if desired, in both edge portions P and Q. The first edge portion P and the second edge portion Q are electrostatically sealed together so as to seal this overlap portion 4. In FIG. 1, reference numeral 5 denotes a portion where the front and rear portions of the packing article are fusion-sealed.

Figure 2:
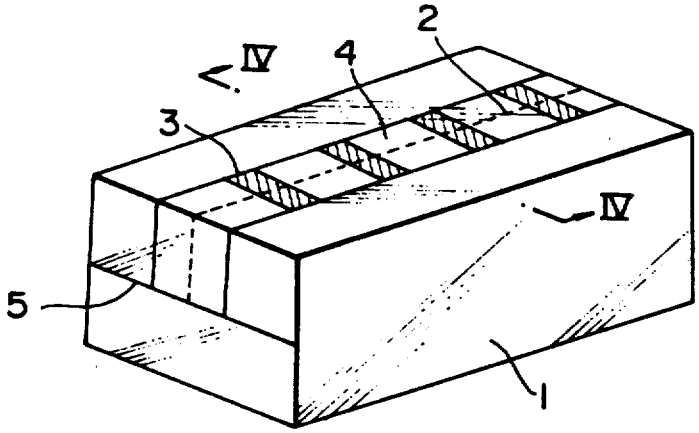

FIG. 2 illustrates another embodiment which is identical to the embodiment of FIG. 1 except that the coated portion 3 is discontinuously formed only in the overlap portion 4 and partially overlaps with the perforations 2.

Figure 4:
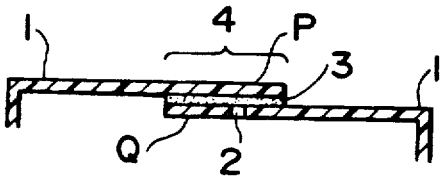
FIGS. 4 to 5 are schematic sectional views taken along line IV—IV of FIG. 2 and showing sealing portions of the packing film.
Figure 5:
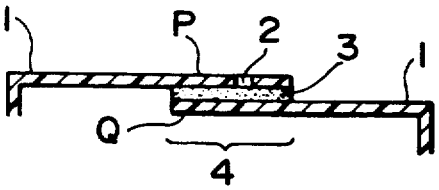
Figure 6:
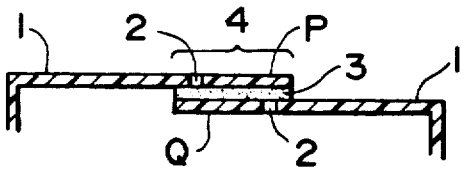
FIG. 6 is a schematic sectional view of another embodiment of the present invention.

As shown in FIG. 4, the second edge portion Q is provided with the perforations 2 in substantially the same manner as in the second edge portion Q in FIG. 3, while the coated portion 3 extends from the edge of the second edge portion Q to fully cover the perforation 2. In this case, therefore, the overlap portion 4 has the substantially same width as the coated portion 3. FIG. 5 illustrates another embodiment which has substantially the same construction as the embodiment as shown in FIG. 4, except for the fact that the perforations 2 are provided only in the first edge portion P. FIG. 6 illustrates a further embodiment which has substantially the same construction as the embodiments as shown in FIGS. 4 and 5, except for the disposition of the perforations 2 in both the first edge portion P and the second edge portion Q.

In accordance with the present invention, the technique for forming the perforations 2 on either of or both of the first and second edge portions P and Q is not restricted to a particular process and may be formed by any conventional processes. Further, the shape and arrangement of the perforations 2 are not restricted. The perforations 2 are formed on along least one edge portion of the film 1 parallel to the extrusion direction (or flow direction).

In the above embodiments, when the perforations 2 to be formed on the second edge portion Q are located in a position very close to the edge of the first edge portion P, the perforations 2 may be separated from the overlap portion 4 during packing, thereby impairing the finish of thermally shrunk packing and further causing breakage of the packing film during handling. On the other hand, when the perforations 2 in the second portion Q are located in a position very close to the edge thereof, the sealing strength at the overlap portion 4 may become too weak, thereby allowing ready breaking of the packing film at the sealed portion during handling of the package. To the contrary, when the perforations 2 formed on the second edge portion Q are located in a position far from the edge of the first edge portion P, the opening capability may become poor even if the coated portion 3 is provided over a large area. When the perforations 2 are located in a position far away from the edge thereof, the synthetic resin film is required to have a larger width.

When the perforations 2 formed in the first edge portion P are located in a position very close to the edge of the first edge portion Q, the perforations 2 may be separated from the overlap portion 4 during packing, thereby impairing the finish of the thermally shrunk packing and further causing breakage of the packing film during handling.

When the perforations 2 formed in the first edge portion P are located in a position very close to the edge of thereof, on the other hand, the sealing strength at the overlap portion 4 may become very weak, thereby causing breakage of the packing film at the sealed portion during handling of the package. To the contrary, when the perforations 2 formed in the first edge portion P are located in a position far from the edge of the second edge portion Q, the opening capability may become poor even if the coated portion 3 is provided. When the perforations 2 of the first edge portion P are formed in a position far away from the edge thereof, a synthetic resin film 1 having a larger width is required.

It is, therefore, preferred that the perforations 2 be located in the overlap portion 4 at a position away by a distance ranging from 3 to 30 mm from the edge of the first edge portion P or from the edge of the second edge portion Q. In other words, as shown in FIG. 3, the length $L_1$ between the edge of the second edge portion Q and the location of the row of the perforations 2 provided on the second edge portion Q may range from approximately 3 mm to 30 mm. The length $L_2$ between the edge of the first edge portion P and the location of the perforations 2 may also range from approximately 3 mm to 30 mm. And, it is preferred that the length $L_3$ of the overlap portion 4, i.e. the sum of the length $L_1$ and the length $L_2$, range from approximately 5 mm to 40 mm. It is further noted that this length $L_3$ is a width in which the first and second edge portions P and Q are electrostatically sealed so as to allow the first edge portion P to be bonded to the second edge portion Q with the coated portion 3 being interposed therebetween.

When the perforations 2 are provided only on the second edge portion Q as shown in FIG. 3, the thermally shrinkable film 1 is unlikely to be broken or becomes less breakable during handling. For instance, the packing film 1 may not be broken even if something would catch the perforations 2. Further, when the perforations 2 are provided on the second edge portion Q only, the appearance of the package looks better.

As described hereinabove, the coated portion 3 is interposed at the overlap portion 4 between the first and second edge portions P and Q. The process for providing the coated portion 3 is not restricted to a particular one and the agent may be coated thereon by any conventional process such as rolling or spraying. When the antistatic agent or the anti-blocking agent is employed for this purpose, it may be coated thereon in the form of a solution in a liquid such as an alcohol or water, or a dispersion therein in an unstably homogeneous state, or a mixture with an ink or a resin composition.

It is to be noted that the coated portion 3 is so disposed as to overlap with at least a part of the overlap portion 4 in which the first edge portion P is bonded to the second edge portion Q.

It has been found less advantageous that the coated portion 3 is disposed only between the edge of the first edge portion P and the perforations 2 when the perforations 2 are formed only in the first edge portion P or that the coated portion 3 is disposed only between the edge of the second edge portion Q and the perforations 2 when the perforation 2 are formed only in the second edge portion Q. In these cases, the adhesion strength at the portion in the overlap portion 4 extending from the perforations 2 to the edge of the film edge portion at which no perforation is provided may become so weak that the packing film is less likely to be broken along the perforations 2 even if the both sides of the overlap portion 4 are pulled away from each other.

Figure 7:
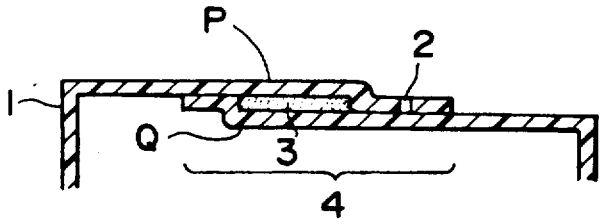
FIG. 7 is a schematic sectional view of yet another embodiment of the present invention.

Hence, it is preferred that, when the perforations 2 are provided only in the first edge portion P, the coated portion be disposed, as shown in FIG. 7, on the side of the edge of the second edge portion Q from the perforations 2 in terms of the sealing strength and ease of opening the packing film.

When the perforations 2 are provided only on the second edge portion Q, on the other hand, it is preferred that the coated portion 3 be located, as shown in FIG. 3, between the edge of the first edge portion P and the perforations 2 in view of the sealing strength and ease of opening the enclosure.

The sealing strength between the first edge portion P and the second edge portion Q may be controlled by controlling the area of the coated portion 3 in the overlap portion 4. To this end, the coated portion 3 may be shortened to a narrow width, or may be arranged in a discontinuous manner (as shown in FIG. 2) or in the form of several lines in spaced relationship.

The coated portion 3 may be formed by applying a coating of the agent for weakening the adhesion strength between the first and second edge portions P and Q on either one of the edge portions P and Q.

The overlap portion 4 is preferably sealed by an electrostatic sealing. The electrostatic sealing to be carried out for the present invention causes the the first and second edge portions P and Q of the thermally shrinkable film to adhere to or to be bonded to each other by causing a sort of blocking between the film edge portions by application of static electricity from a static electricity generator. The portion where both of the film edge portions are sealed by electrostatic means presents a flat, transparent and better look without any scars which look poor in appearance, unlike a portion sealed by conventional sealing processes such as that using hot plates, for example.

As described hereinabove, the package of an article enclosed with the thermally shrinkable packing film has its overlap portion rendered less adhesive by providing the coated portion. Therefore, when the overlap portion of the packing film thermally shrunken is pulled from both sides in order to open the packing article, the packing film can readily be torn at the perforations and opened. Further, since the perforations are closed by one of the film edge portions, the air within the packing film is prevented from being discharged through the opening and thermal shrinkage can be smoothly performed, thereby providing a better finish of the thermally shrunk packing.

In particular, when the perforations are provided in the second edge portion Q only and when the coated portion is located between the edge of the first edge portion P and the perforations 2, the adhesion is low at the portion between the perforations 2 and the first edge portion P, while the adhesion is high at the portion extending from the perforations to the edge of the second edge portion Q where no seal-preventing agent is coated. In this case, when the overlap portion 4 of the packing film is pulled from both sides for opening the enclosure, the portion located between the perforations and the edge of the second edge portion Q is not delaminated while the portion located between the perforations and the edge of the first edge portion P is readily delaminated, so that the perforations are torn and the package is opened with ease. Furthermore, since the perforations are covered with the first film edge portion there is no fear that something would catch the perforations.

The present invention will be described in more detail by way of examples.

EXAMPLE 1

A sheet of a thermally shrinkable polypropylene film was provided on one of its edge portions with a series of perforations, each having a length of 3 mm and spaced by 10 mm from the edge thereof at equal intervals of 1.5 mm. Further, a coated portion having the width of 30 mm was provided immediately inside the perforations (i.e., on the central side of the film) by coating a solution of a conventional cation-type surfactant in an alcohol as an antistatic agent for the ink using rolls. Opposite edge portions were then superimposed on and overlapped with each other by approximately 30 mm in width from both edges thereof so as to interpose the coated portion between them. The overlap portion was then sealed electrostatically, thereby forming a packing material in a cylindrical shape. The position relationship between the perforations and the coated portion within the overlap portion was as shown in FIG. 3.

Three note books were inserted into the packing material. The packing material was then fusion-bonded at their front and rear open ends and passed through a thermally shrinking tunnel, yielding the thermally shrunk package.

This thermally shrunk package was found to be remarkably good in finish and it was not broken during handling in a general way. When the overlap portion was pulled from both sides in order to take the note books out, the film was readily torn along the perforations and the packing article was opened with ease.

EXAMPLE 2

The thermally shrunk package was prepared in substantially the same manner as in Example 1, except for using an aqueous uniform dispersion of an anti-blocking agent of a silica type, in place of the antistatic agent.

The resulting packing article was found to have good finish, like that prepared in Example 1, and the package was readily opened. Further, it was not broken during general handling.

EXAMPLE 3

The thermally shrunk package was prepared in substantially the same manner as in Example 1, except for using an ink containing an acryl-type resin as a medium and an antistatic agent of a special carboxylate type polymer.

The resulting package was found to have a remarkably good finish like that prepared in Example 1, and was readily opened. Further, it was not broken during general handling.

It has been found from the results of the Examples above that the package according to the present invention provided at its overlapped and electrostatically sealed portion with a coating of a seal-preventive agent can be opened with ease. Further, the package has a good finish appearance.

These effects are prominent when the perforations and the coated portion are arranged in a particular and preferred position relationship. The package is unlikely to be broken during handling in a general way yet it can be torn off along the perforations and opened with ease when the overlap portion sealed electrostatically is pulled from both sides in order to take the contents out from the package. Further, it has been found that the package according to the present invention is unlikely to be broken easily even if something would catch the perforations.

Although the present invention has been fully described in connection with the preferred embodiments thereof with reference to the accompanying drawings which are used only for the purpose of illustration, those skilled in the art will readily conceive numerous changes and modifications within the frame work of obviousness upon the reading of the specification herein. Accordingly, such changes and modifications are to be construed as included.

What is claimed is:

1. A package comprising an enclosed article, and a thermally shrinkable, synthetic resin film enclosing the article and having a first edge portion adjacent a first end and a second edge portion adjacent a second end, said first edge portion being superimposed on and sealed to said second edge portion to form a sealed, overlap portion, said film having perforations arranged in a row in at least one of said first and second edge portions and a coating of a seal-preventive agent provided in part of said overlap portion for weakening the seal in said overlap portion.

2. A package as claimed in claim 1, wherein said perforations are formed only in the second edge portion.

3. A package as claimed in claim 2, wherein said coating is formed between the row of the perforations of said second edge portion and said first end.

4. A package as claimed in claim 1, wherein said perforations are formed at least in said first edge portion and said coating is formed between the row of the perforations of said first edge portion and said second end.

5. A package as claimed in claim 1, wherein said perforations are formed at least in said second edge portion and said coating is formed between the row of the perforations of said second edge portion and said first end.

6. A package as claimed in claim 1, wherein said seal is effected by electrostatic sealing and said seal-preventive agent is an ink, a resin, an antistatic agent, an anti-blocking agent or a mixture thereof.

* * * * *

UNITED STATES PATENT AND TRADEMARK OFFICE

CERTIFICATE OF CORRECTION

PATENT NO. : 5,129,518

DATED : July 14, 1992

INVENTOR(S) : TANAKA et al

It is certified that error appears in the above-identified patent and that said Letters Patent is hereby corrected as shown below:

Col. 2, line 32, delete "so super-";

line 33, delete "imposed as" and delete "so superimposed as".

Signed and Sealed this

Nineteenth Day of October, 1993

*Attest:*

*Attesting Officer*

BRUCE LEHMAN

*Commissioner of Patents and Trademarks*